US005899555A

United States Patent [19]

Lin

[11] Patent Number: 5,899,555

[45] Date of Patent: May 4, 1999

[54] ARTIFICIAL FLOWER LAMP ASSEMBLY

[76] Inventor: Mei-Lu Lin, 56, Min Sheng Street, Fengyuan, Taichung Hsien, Taiwan, 420

[21] Appl. No.: 08/926,960

[22] Filed: Sep. 10, 1997

[51] Int. Cl.[6] ..... F21P 1/02

[52] U.S. Cl. ..... 362/122; 362/123; 362/252; 362/391; 362/806

[58] Field of Search ..... 362/122, 123, 362/238, 239, 249, 250, 252, 391, 806

[56] References Cited

U.S. PATENT DOCUMENTS 3,050,619 8/1962 Abramson ..... 362/122
3,619,598 11/1971 Merril ..... 362/122

*Primary Examiner*—Alan Cariaso
*Assistant Examiner*—Todd R. Hopper

[57] ABSTRACT

An artificial flower lamp assembly comprises a main trunk, a plurality of branches connected to the main trunk, a plurality of artificial flower lamps connected to the branches, and a plurality of bulbs disposed in the artificial flower lamps. The main trunk encloses a main wire.

3 Claims, 8 Drawing Sheets

ARTIFICIAL FLOWER LAMP ASSEMBLY

BACKGROUND OF THE INVENTION

This invention relates to an artificial flower lamp assembly, and more particularly to an artificial flower lamp assembly which contains a plurality of artificial flower lamps.

A conventional lamp assembly for a Christmas tree has a plurality of decoration lamps. However, the decoration lamps are separated from artificial flowers on the Christmas tree. The decoration lamps cannot illuminate the artificial flowers clearly.

SUMMARY OF THE INVENTION

An object of this invention is to provide an artificial flower lamp assembly which contains a plurality of artificial flowers so that a plurality of decoration lamps can illuminate the artificial flowers clearly.

DETAILED DESCRIPTION OF THE INVENTION

Figures 1, 1A, 1B:
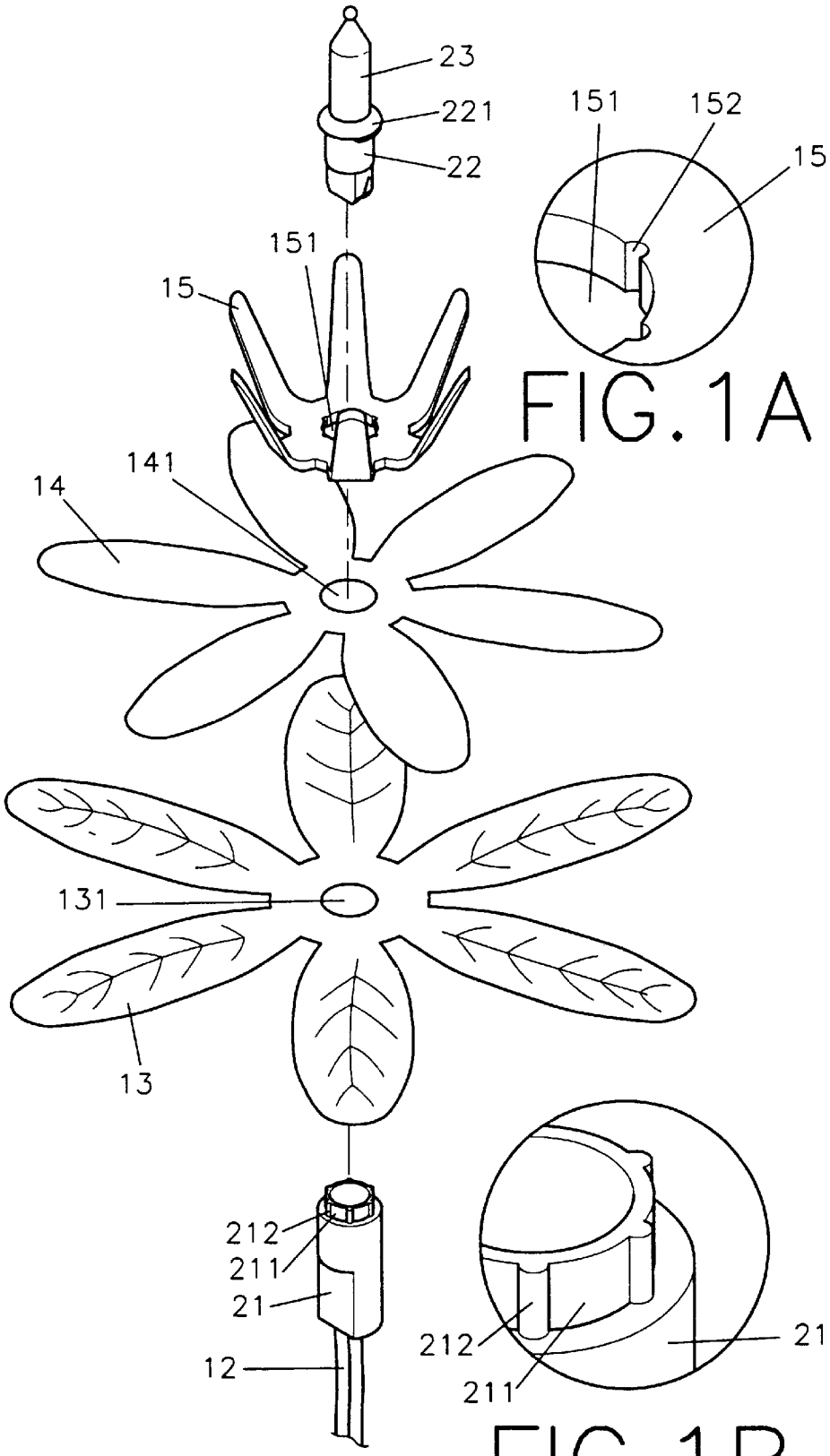
FIG. 1 is a perspective exploded view of an artificial flower lamp of a preferred embodiment.
FIG. 1A is a partially enlarged view of a support seat in FIG. 1.
FIG. 1B is a partially enlarged view of a socket in FIG. 1.
Figure 2:
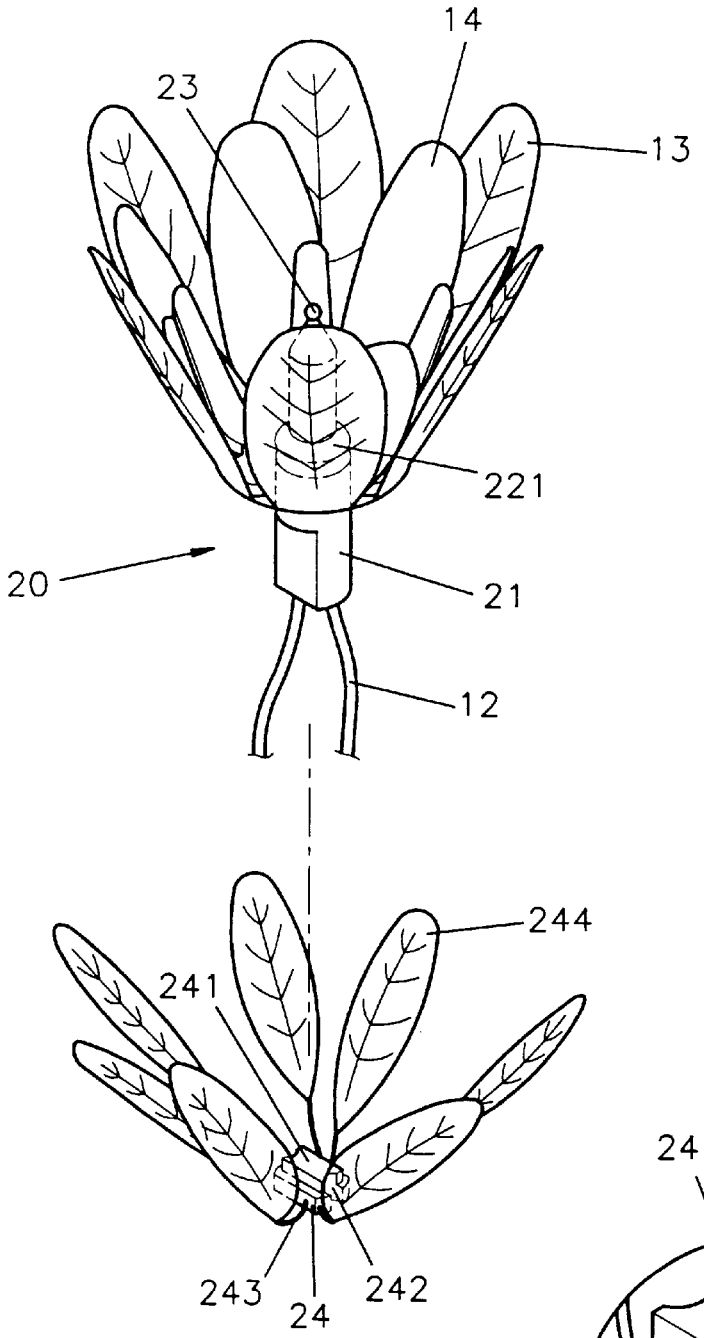
FIG. 2 is a perspective view of an artificial flower lamp and a positioning seat.
Figure 2A:
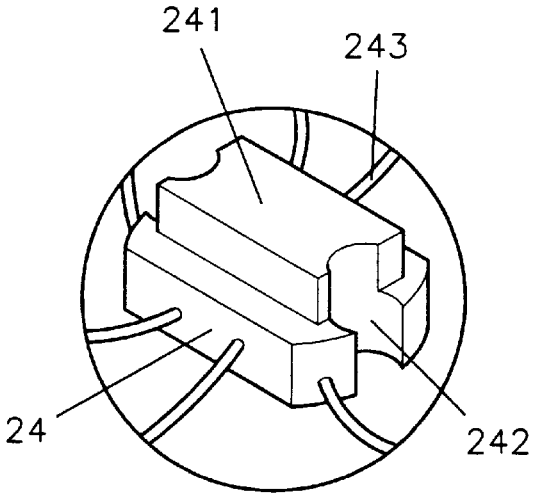
FIG. 2A is a partially enlarged view of a positioning seat.

Referring to FIGS. 1 to 5, an artificial flower lamp assembly comprises a main trunk 11, a plurality of branches 12 connected to the main trunk 11, a plurality of artificial flower lamps 20 connected to the branches 12, and a plurality of bulbs 23 disposed in the artificial flower lamps 20. The main trunk 11 encloses a main wire 111.

Each artificial flower lamp 20 has a leaf device 13 having a round hole 131, a flower device 14 having a circular hole 141, a support seat 15 having a through hole 151 and a plurality of inner periphery slots 152 communicating with the through hole 151, and a socket 21. The flower device 14 is disposed on the leaf device 13. The support seat 15 is disposed on the flower device 14. The socket 21 has an annular ring 211 and a plurality of protruded bars 212 disposed on an outer periphery of the annular ring 211. The socket 21 receives the branch 12. The annular ring 211 passes through the round hole 131, the circular hole 141, and the through hole 151. A lamp holder 22 is inserted in the socket 21. A flange 221 is formed on the lamp holder 22. A bulb 23 is inserted in the lamp holder 22. Each protruded bar 212 is inserted in each respective inner periphery slot 152.

Figure 3:
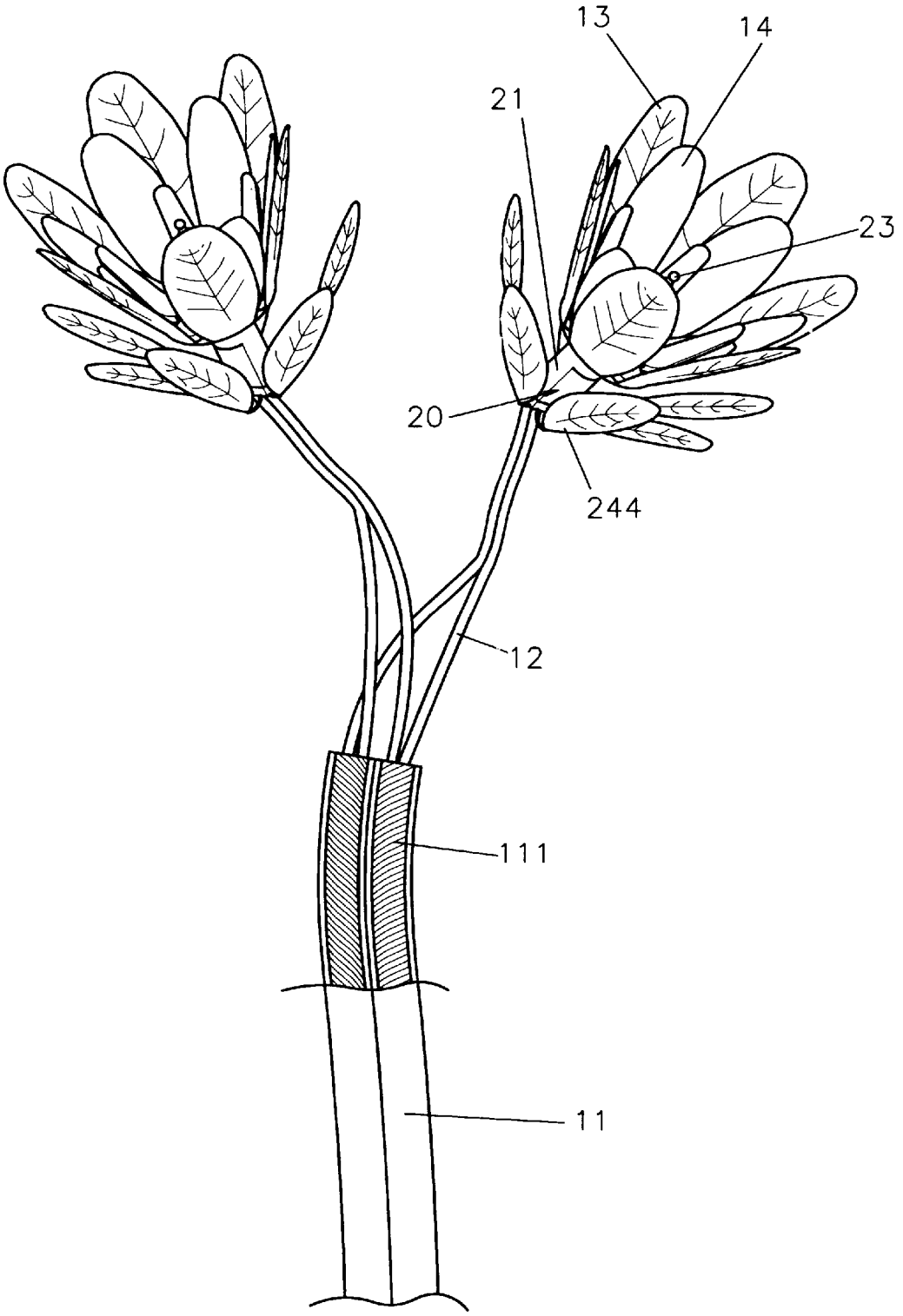
FIG. 3 is a perspective view of an artificial flower lamp assembly of a first preferred embodiment.
Figure 4:
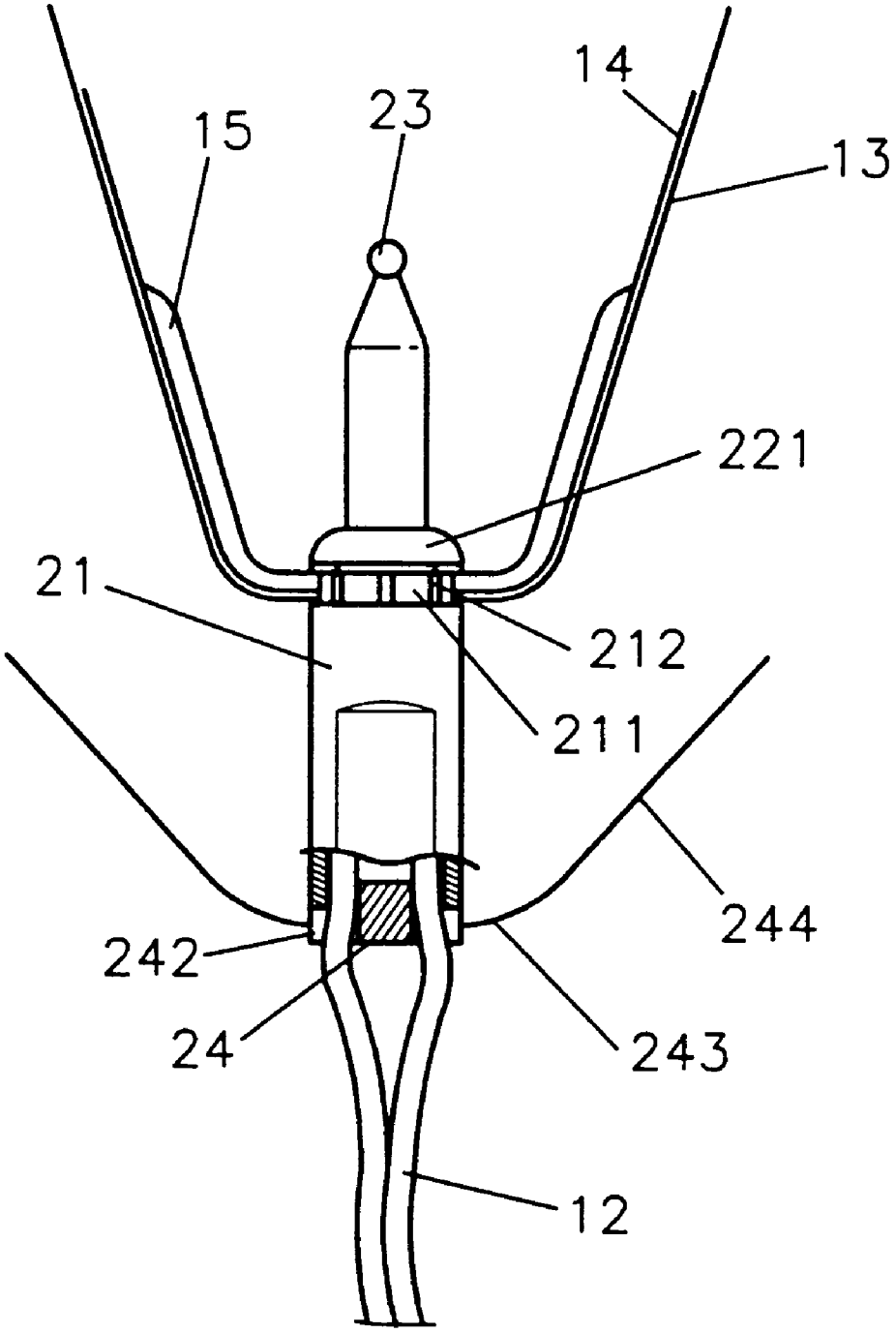
FIG. 4 is a sectional assembly view of FIG. 2.
Figure 5:
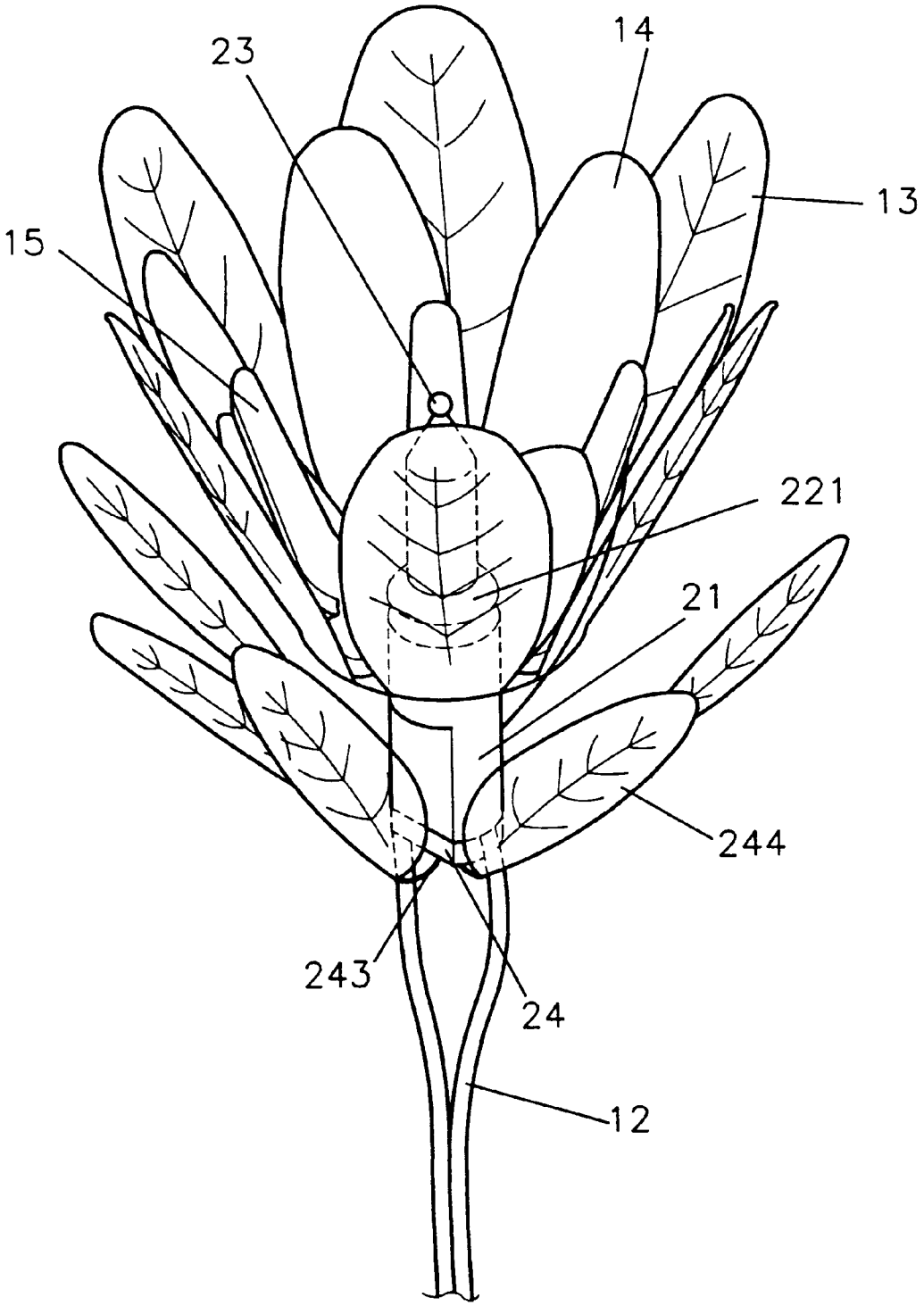
FIG. 5 is a perspective assembly view of FIG. 2.

Referring to FIGS. 2, 2A, 4 and 5, a positioning seat 24 has a protruded plate 241, two notches 242 and a plurality of twigs 243. Each twig 243 is connected to a leaflet 244. The protruded plate 241 is inserted in a bottom of the socket 21. Each notch 242 receives a branch 12. Thus the socket 21 is covered by the leaflets 244. The appearance of the artificial flower lamp assembly 20 is beautiful (as shown in FIG. 3).

Figure 6:
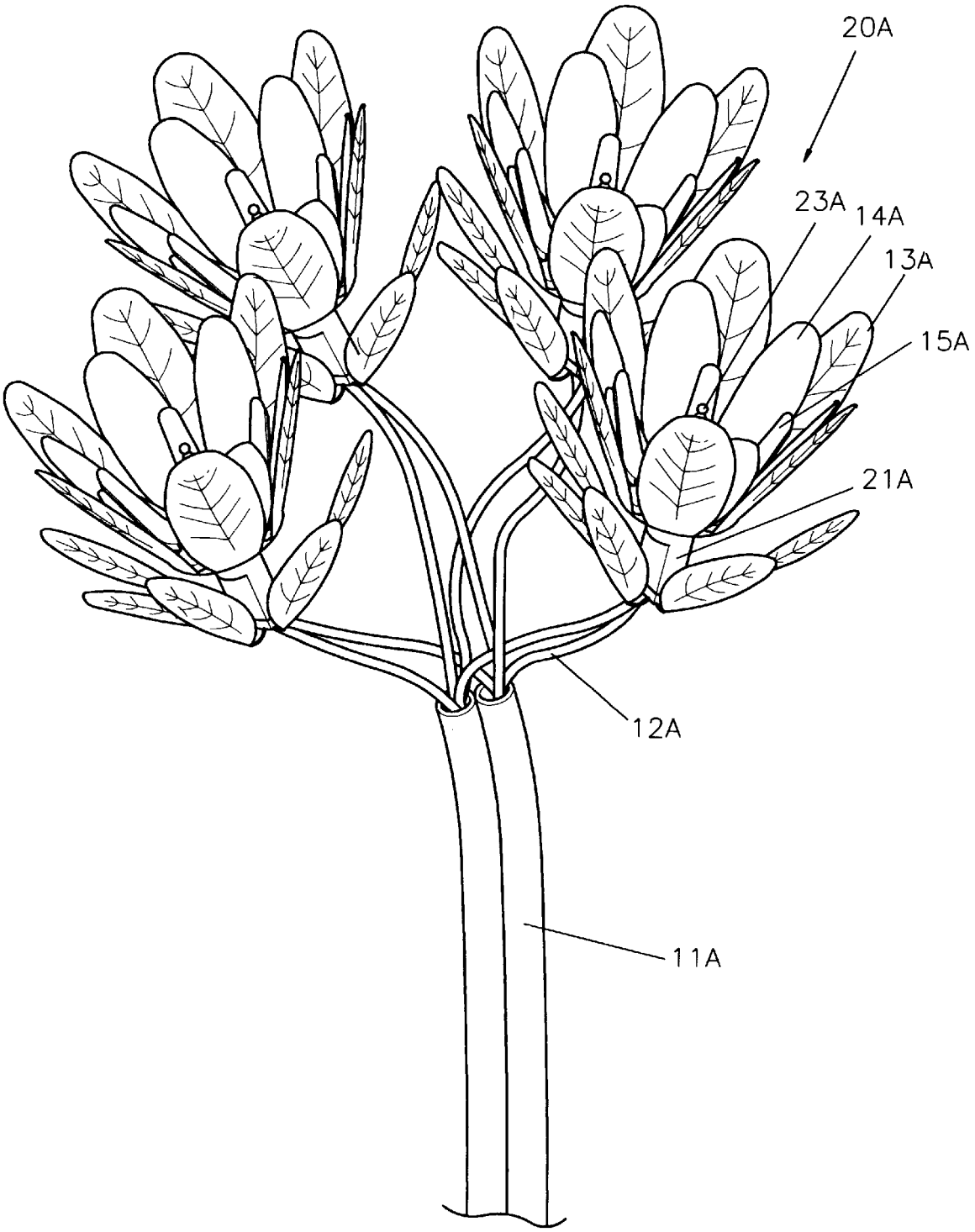
FIG. 6 is a perspective view of an artificial flower lamp assembly of a second preferred embodiment.

Referring to FIG. 6, a second artificial flower lamp assembly comprises a main trunk 11*a*, a plurality of branches 12*a* connected to the main trunk 11*a*, a plurality of artificial flower lamps 20*a* connected to the branches 12*a*, and a plurality of bulbs 23*a* disposed in the artificial flower lamps 20*a*. Each artificial flower lamp 20*a* comprises a leaf device 13*a*, a flower device 14*a*, and a socket 21*a*. The flower device 14*a* is disposed on the leaf device 13*a*. The support seat 15*a* is disposed on the flower device 14*a*. The socket 21*a* receives the branch 12*a*. A bulb 23*a* is inserted in a lamp holder (not shown in the figures).

Figure 7:
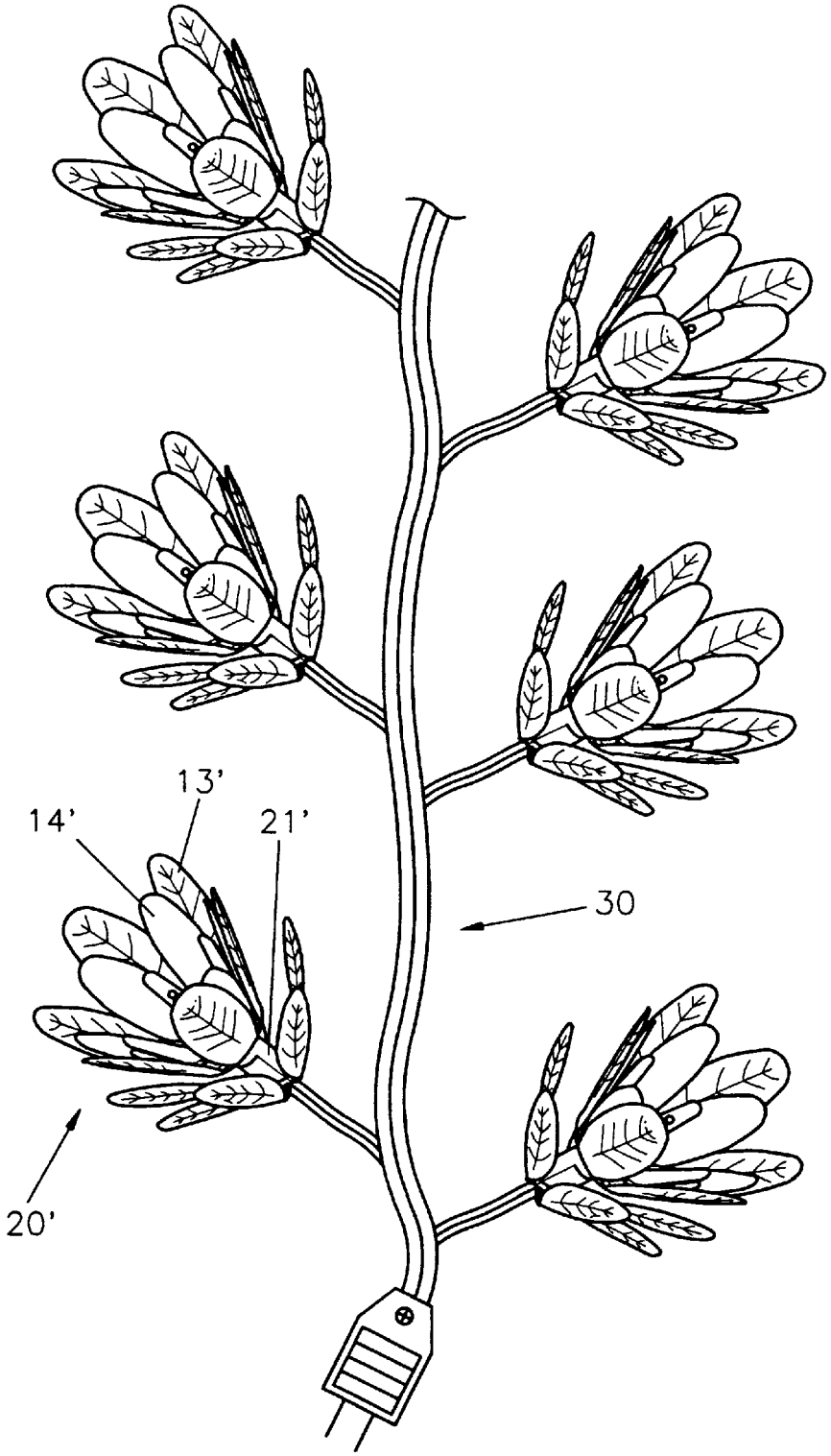
FIG. 7 is a perspective view of a serial flower lamp assembly.

Referring to FIG. 7, a plurality of artificial flower lamp assembly are disposed in series to form a serial flower lamp assembly 30. Each artificial flower lamp assembly 20' comprises a leaf device 13', a flower device 14', and a socket 21'.

Figure 8:
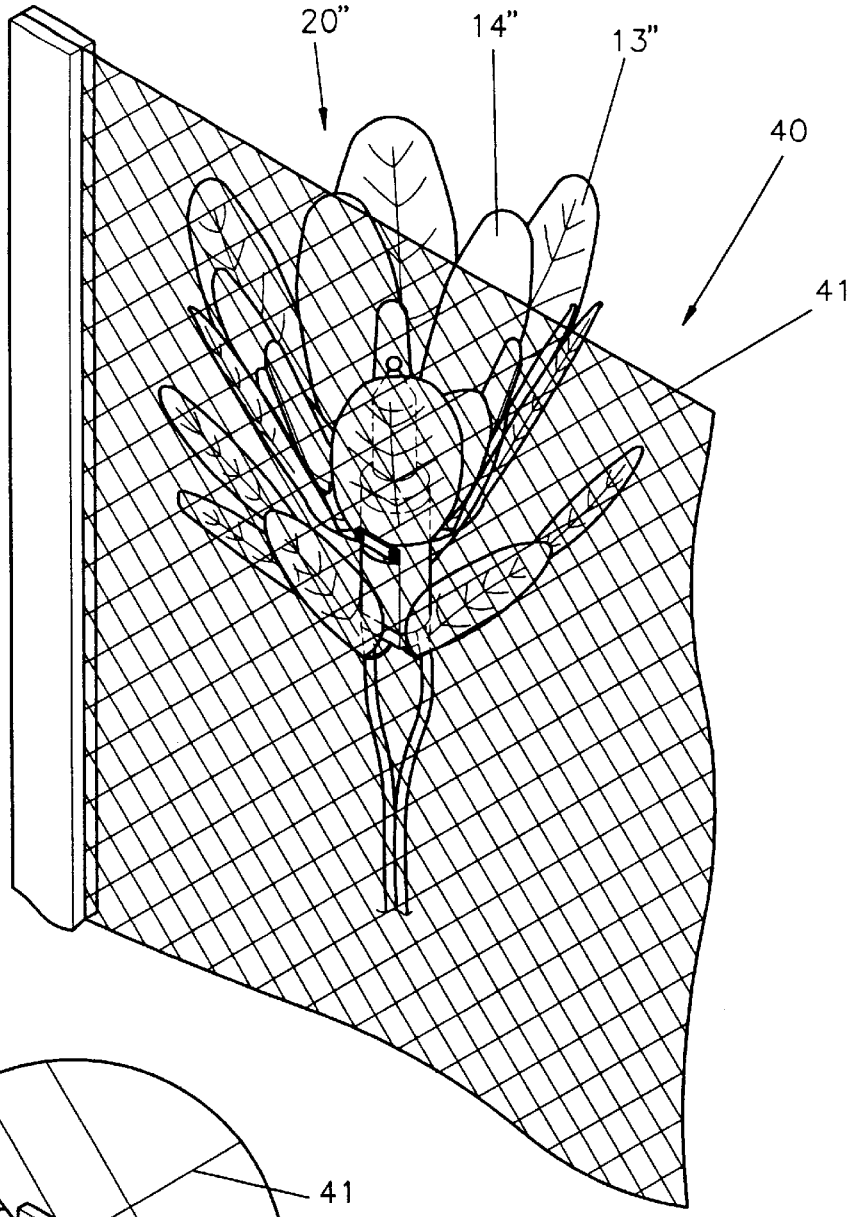
FIG. 8 is a schematic view illustrating an artificial flower lamp positioned on a net.
Figure 8A:
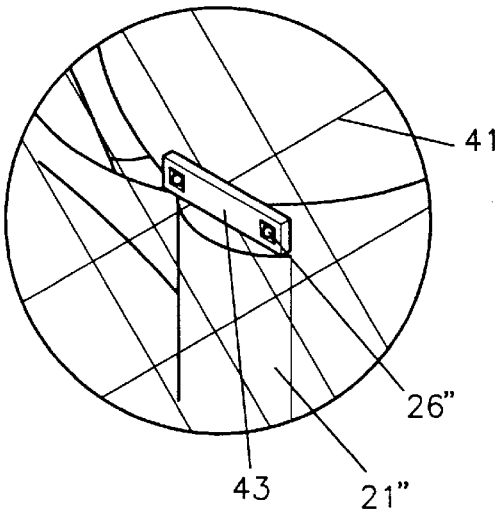
FIG. 8A is a partially enlarged view of FIG. 8.

Referring to FIGS. 8 and 8A, an artificial flower lamp assembly 20" is positioned on a net 40. The net 40 has a plurality of strings 41. The artificial flower lamp assembly 20" comprises a leaf device 13", a flower device 14", and a socket 21". A plurality of protrusions 26" are disposed on the socket 21" to engage with a support plate 43 on the string 41 of the net 40.

I claim:

1. An artificial flower lamp assembly comprises:

a main trunk, a plurality of branches connected to the main trunk, a plurality of artificial flower lamps connected to the branches, a plurality of bulbs disposed in the artificial flower lamps, the main trunk enclosing a main wire, each said artificial flower lamp having a leaf device having a round hole, a flower device having a circular hole, a support seat having a through hole and a plurality of inner periphery slots communicating with the through hole, and a socket, the flower device disposed on the leaf device, the support seat disposed on the flower device, the socket having an annular ring and a plurality of protruded bars disposed on an outer periphery of the annular ring, the socket receiving the branch, the annular ring passing through the round hole, the circular hole, and the through hole, a lamp holder inserted in the socket, a bulb inserted in the lamp holder, and each said protruded bar inserted in each said respective inner periphery slot.

2. An artificial flower lamp assembly as claimed in claim 1, wherein a positioning seat has a protruded plate, two notches and a plurality of twigs, each said twig is connected to a leaflet, and the protruded plate is inserted in a bottom of the socket.

3. An artificial flower lamp assembly as claimed in claim 1, wherein a plurality of said artificial flower lamp assembly are disposed in series to form a serial flower lamp assembly.

* * * * *